US005879196A

United States Patent [19]

Lee

[11] Patent Number: 5,879,196

[45] **Date of Patent: *Mar. 9, 1999**

[54] CABLE CONNECTING STRUCTURE OF SERIAL BUS CONNECTOR

[76] Inventor: Su-Lan Yang Lee, 4th Floor, No. 506-2, Yuan-Shan Road, Chung-Ho City, Taipei Hsien, Taiwan

[ * ] Notice: This patent issued on a continued prosecution application filed under 37 CFR 1.53(d), and is subject to the twenty year patent term provisions of 35 U.S.C. 154(a)(2).

[21] Appl. No.: 791,425

[22] Filed: Jan. 30, 1997

[30] Foreign Application Priority Data

Jan. 17, 1997 [TW] Taiwan ..... 86200861

[51] Int. Cl.[6] ..... H01R 17/00; H01R 19/00; H01R 21/00; H01R 23/00

[52] U.S. Cl. ..... 439/660; 439/604; 439/731; 439/746

[58] Field of Search ..... 439/465, 660, 439/687, 731, 733.1, 736, 752, 604, 746

[56] References Cited

U.S. PATENT DOCUMENTS 3,275,765 9/1966 Ferdon et al. ..... 439/660
5,295,843 3/1994 Davis et al. ..... 439/660
5,308,258 5/1994 Hatsios ..... 439/731

*Primary Examiner*—Neil Abrams
*Assistant Examiner*—Katrina Davis
*Attorney, Agent, or Firm*—Rosenberg, Klein & Bilker

[57] ABSTRACT

A cable connecting structure of serial bus connector, including a main body, multiple contacts inserted in the main body and a cover member covering the main body. The main body includes a rear retaining seat formed with multiple guide channels, a front coupling seat formed with multiple guide cavities, and multiple through holes passing through the main body to communicate with the guide channels and the guide cavities. Each contact includes a rear cable connecting section, a front conductive coupling section and a locating section interconnecting the cable connecting section with the conductive coupling section. The cable connecting section is received in the guide channel of the retaining seat in a bridge pattern and connected with a front end of a cable. The conductive coupling section is received in the guide cavity of the coupling seat in a bridge pattern. The locating section is engaged in the through hole of the main body. The cover member is detachably assembled with the retaining seat of the main body for cooperatively enclosing the cable connecting section of the contact and the cable.

1 Claim, 8 Drawing Sheets

CABLE CONNECTING STRUCTURE OF SERIAL BUS CONNECTOR

BACKGROUND OF THE INVENTION

The present invention relates to a cable connecting structure of serial bus connector, and more particularly to a cable connecting structure of serial bus connector, which can be assembled without any specific tool.

FIGS. 1–1B show a conventional cable connecting structure of serial bus connector, including a main body 100 and multiple contacts 200. The main body 100 has a front section formed with a coupling seat 101 disposed with multiple guide channels 102. The main body 100 is formed with multiple through holes 103 respectively corresponding to the guide channels 102, whereby the contacts 200 can be inserted into the through holes 103 with their front conductive coupling sections 201 exposed and received in the guide channels 102 of the coupling seat 101 in a bridge pattern. Each contact 200 has a rear securing section 202 formed with ratchets 203 on two sides for engaging with the wall of the through hole 103 so as to secure the contact 200 therein. After the contacts 200 are assembled with the main body 100, a metal frame body 400 is fitted around the main body 100 and the rear section of the metal frame body 400 is coated with an insulative plastic layer 401 as shown in FIG. 1B to form a serial bus connector. Several shortcomings exist in the above arrangement as follows:

1. When assembled, a specifically designed tool must be used to insert the contacts 200 into the main body 100 with the ratchets 203 hooked in the through holes 103. Therefore, each production line necessitates an expensive tool for production. This increases the manufacturing cost of the connector.
2. Each contact has a cable connecting end 204 exposed outside the main body 100 very near the through hole 103, so that the high temperature generated during soldering of the cable 300 often melts and deforms the wall 103' of the through hole 103 near the securing section 203 of the contact 200 as shown in FIG. 1A. As a result, the ratchets 203 often fail to tightly engage with the wall of the through hole 103. Therefore, the contact 200 will slip back and forth to form a defective product.
3. The main body 100 has a rear vertical end face and the cable connecting end 204 of the contact and the cable 300 soldered therewith protrude from the vertical end face as a cantilever without being securely supported and enclosed. Therefore, during the successive working procedure, the contact and cable are apt to be pulled and torn apart.
4. The cables 300 soldered with the contacts are not isolated from each other by any insulative body so that the adjacent cables 300 are very easy to touch each other to cause a short circuit.
5. In the injection operation of the insulative layer 401 for coating the rear section of the metal frame body 400 as shown in FIG. 1B, because the contact 200 is not designed with any plastic stopper means, the molten insulative plastic tends to flow through the clearance 104 between the contact 200 and the wall of the through hole 103 onto the conductive coupling section 201 of the contact. This will affect the conduction efficiency of the contact to form a defective product.

SUMMARY OF THE INVENTION

In order to obviate the above shortcomings, it is a primary object of the present invention to provide a cable connecting structure of serial bus connector, in which:

1. The contacts can be assembled with the main body of the serial bus connector without using any specific tool so that the equipment cost is reduced.
2. The main body is easily detachably associated with a cover member directly by latching so as to enclose and protect the cable connecting end of the contact and the cable soldered therewith from being torn apart. In addition, it becomes easier to maintain or repair the contact and cable.
3. The contact and the cover member are disposed with double plastic stopper designs for sealing the through hole of the main body. Therefore, in the injection operation of the molten insulative plastic material for coating the metal frame body, the insulative plastic material is prevented from flowing toward the conductive coupling section of the contact, so that a good efficiency of electrical conduction can be maintained.

The present invention can be best understood through the following description and accompanying drawings, wherein:

DETAILED DESCRIPTION OF THE PREFERRED EMBODIMENT

Figure 1:
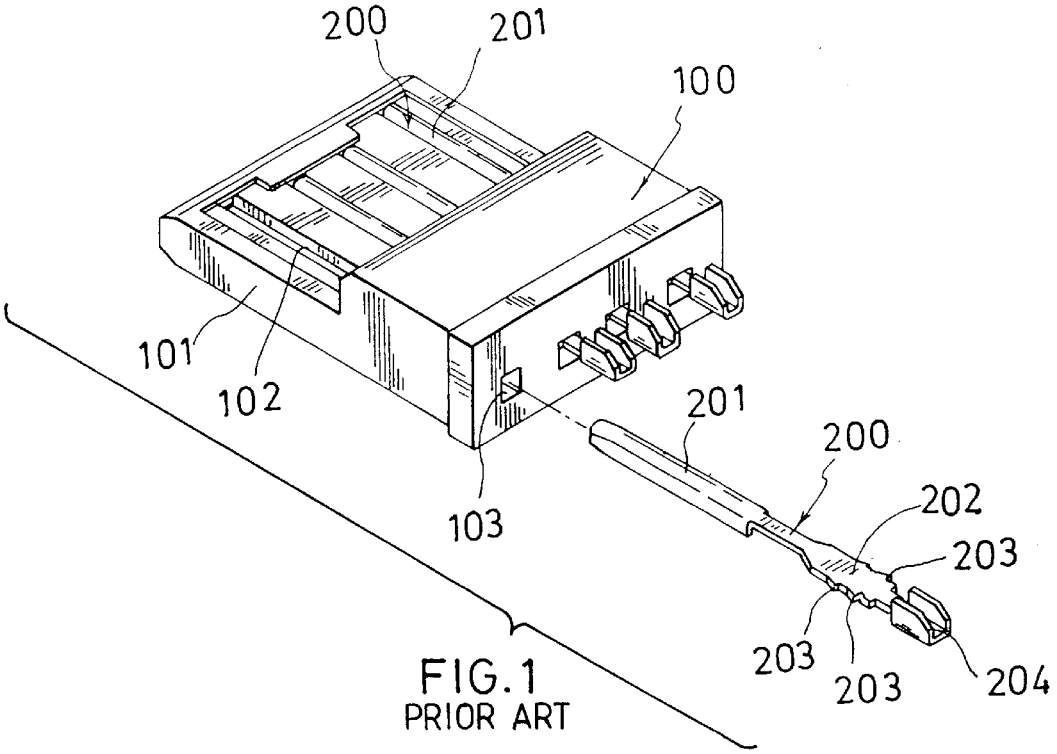
FIG. 1 PRIOR ART
FIG. 1 is a perspective partially exploded view showing the conventional cable connecting structure of serial bus connector.
Figure 1A:
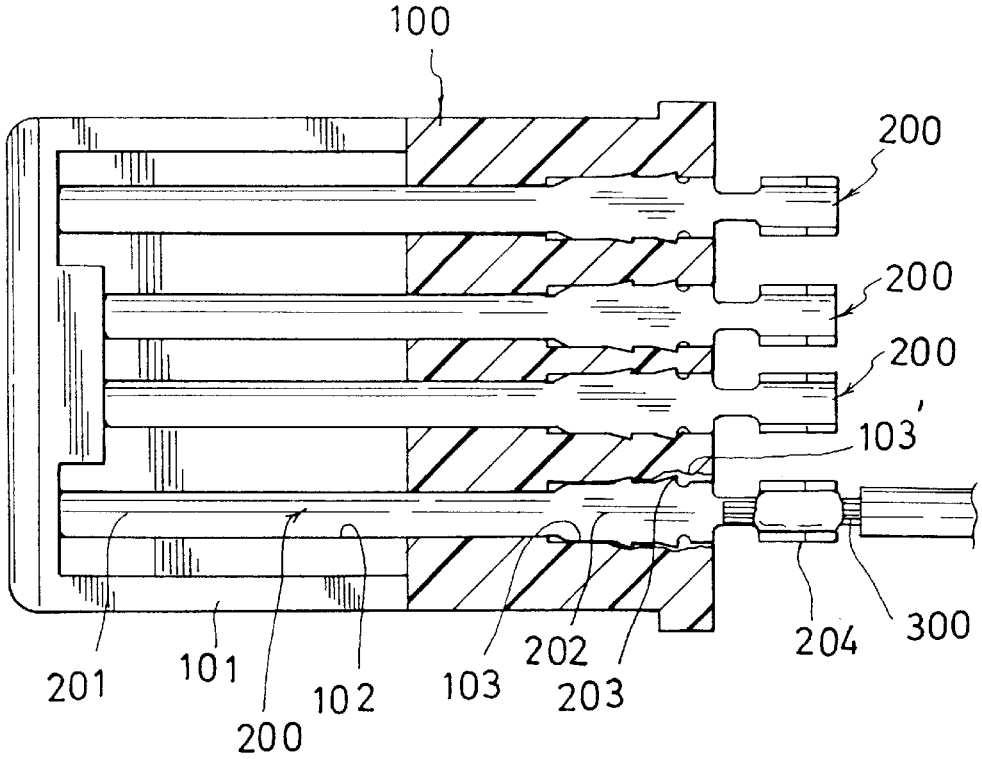
FIG. 1A PRIOR ART
FIG. 1A is a top partially sectional view of the assembly of the main body and the contacts of the conventional cable connecting structure according to FIG. 1.
Figure 1B:
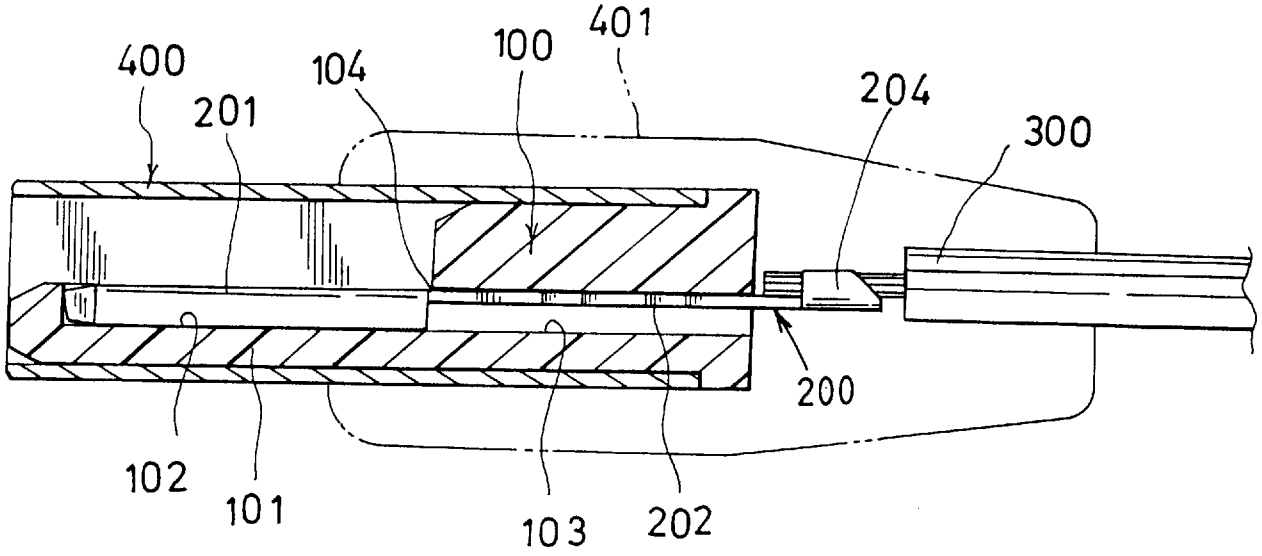
FIG. 1B PRIOR ART
FIG. 1B is a side partially sectional view of the conventional cable connecting structure according to FIGS. 1.

Please refer to FIGS. 2 to 9. The present invention includes a main body 1, multiple contacts 2 inserted in the main body 1 and a cover member 3 detachably latched with and covering a rear retaining seat 11 of the main body 1 for securely enclosing the cable connecting sections 21 of the contacts 2 and the cables 20.

Figure 2:
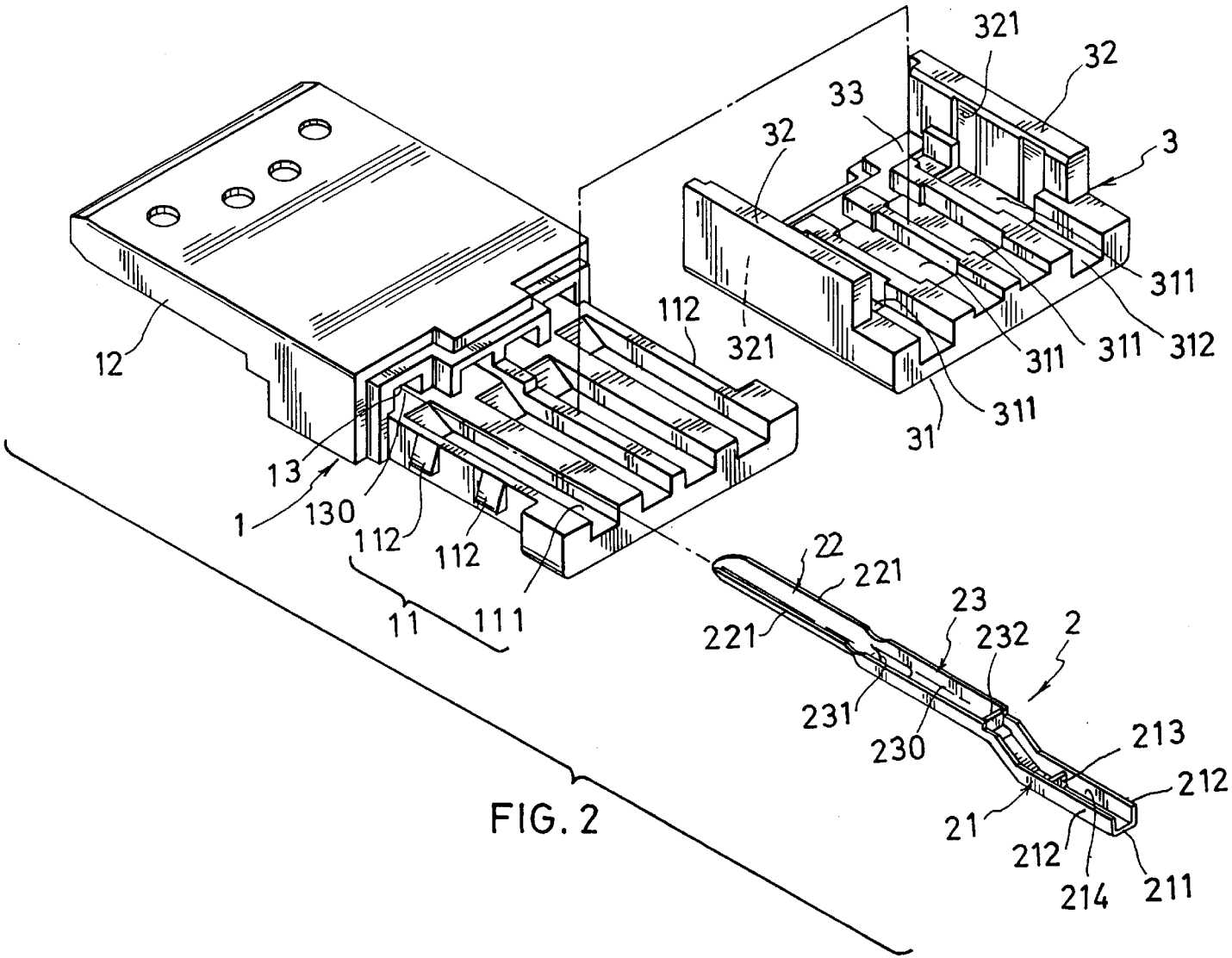
FIG. 2 is a perspective exploded view of the main body, cover member and contact of the present invention.
Figure 3:
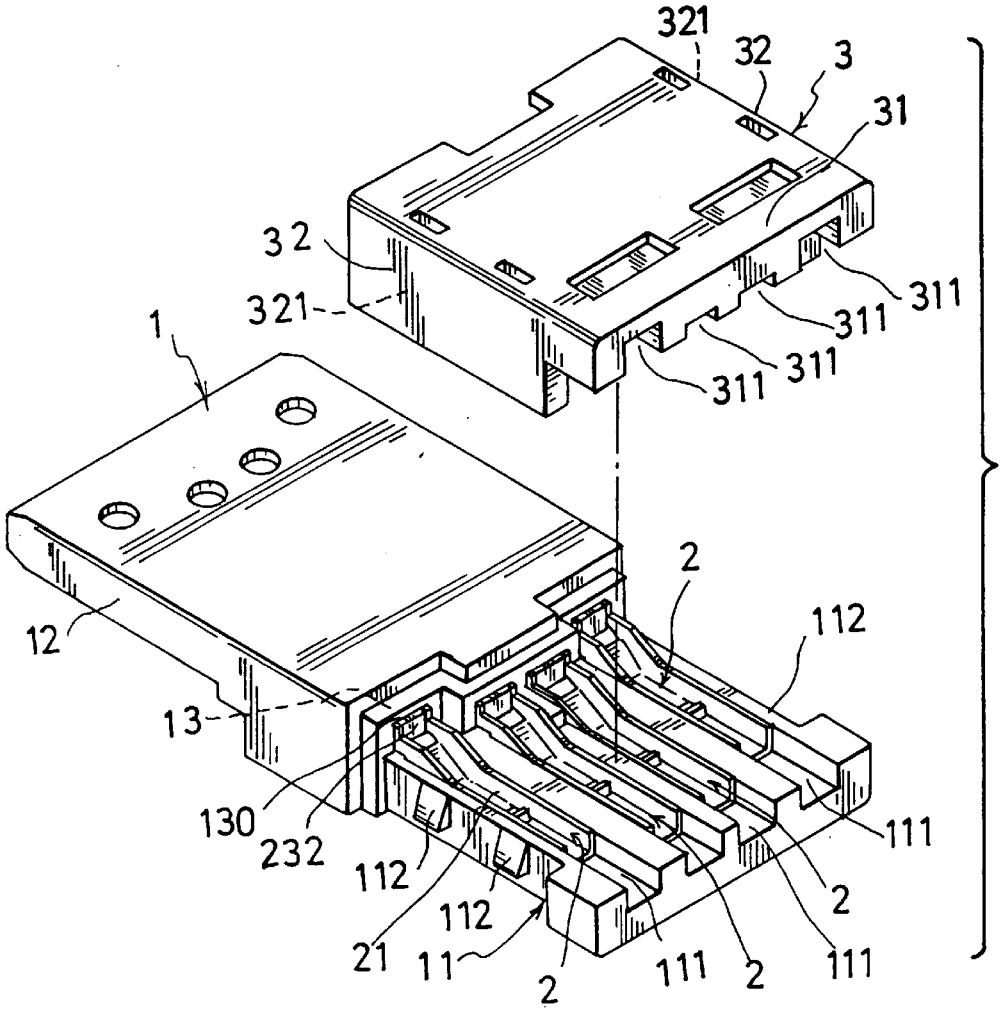
FIG. 3 is a perspective exploded view according to FIG. 2, wherein the contacts are assembled with the main body.
Figure 4:
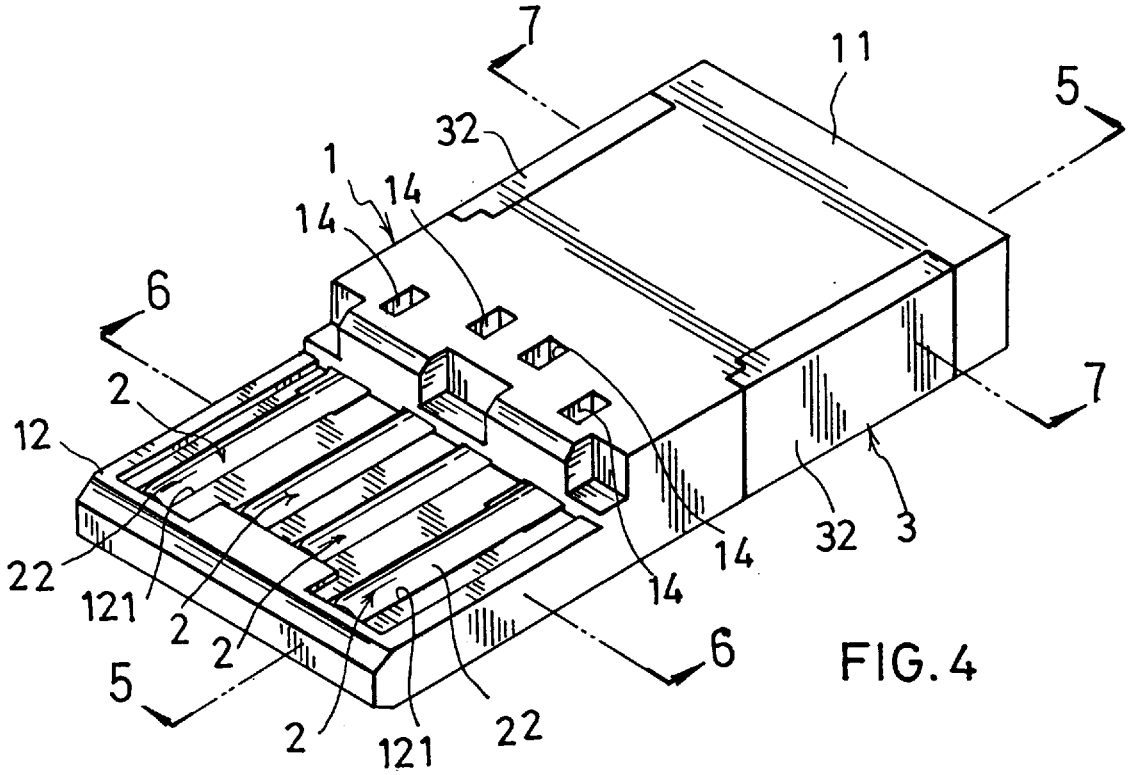
FIG. 4 is a perspective assembled view of the main body, contacts and cover member of the present invention.

As shown in FIGS. 2 to 4, the main body 1 includes a rear retaining seat 11 formed with multiple guide channels 111 for receiving the cable connecting sections 21 of the contacts 2 and the cables 20. The retaining seat 11 is formed with at least one first latch section 112 on each side. The main body 1 further includes a front coupling seat 12 formed with multiple guide cavities 121 for receiving the front conductive coupling sections 22 of the contacts 2. The main body 1 is also formed with multiple through holes 13 passing through the main body 1 to communicate with the guide channels 111 and the guide cavities 121.

Figure 5:
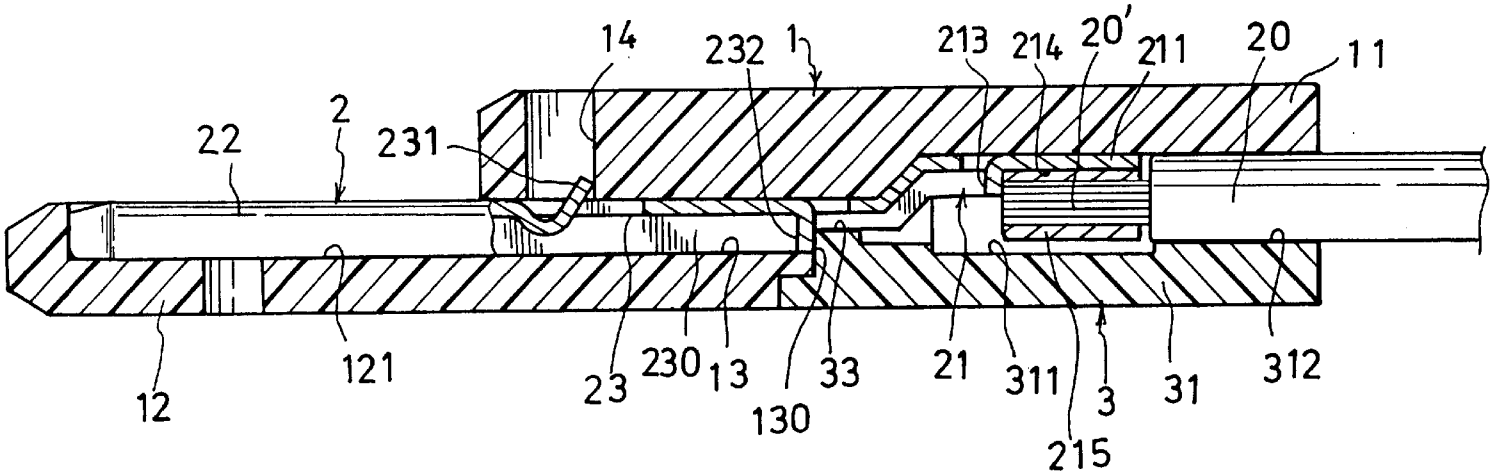
FIG. 5 is a sectional view taken along line 5—5 of FIG. 4.

Each contact 2 is integrally made of an electrically conductive material by punching, including a rear cable connecting section 21, a front conductive coupling section 22 and a locating section 23 interconnecting the cable connecting section 21 and the conductive coupling section 22. The cable connecting section 21 includes a board body 211 and two lateral walls 212 respectively perpendicularly extending from two sides of the board body 211. In addition, a stopper board 213 projects from the board body 211 to define a receptacle 214 for receiving the solder 215 for soldering a front bare wire of the cable 20. The front conductive coupling section 22 of the contact 2 has a cross-section shaped as the guide cavity 121 of the coupling seat 12 of the main body 1, whereby the conductive coupling section 22 can be snugly and securely received in the guide cavity 121 in a bridge pattern. The locating section 23 of the contact 2 has a cross-section shaped as the through hole 13 of the main body 1. A detective latch plate 231 resiliently outward extends from the locating section 23. In addition, a plastic stopper board 232 projects from the rear side of the locating section 23 for sealing a central groove 230 of the locating section 23. Accordingly, as shown in FIGS. 3 and 5, the contact 2 is passed through the through hole 13 of the main body 1 with the detective latch plate 231 resiliently latched in a locating dent 14 of the main body 1 and with the plastic stopper board 232 sealing a rear inlet 130 of the through hole 13. At this time, the cable connecting section 21 of the contact 2 is securely received in the guide channel 111 of the retaining seat 11 in a bridge pattern, while the conductive coupling section 22 of the contact 2 is securely received in the guide cavity 121 of the coupling seat 12 in a bridge pattern. Therefore, the contact 2 is firmly located in the main body 1.

Figure 6:
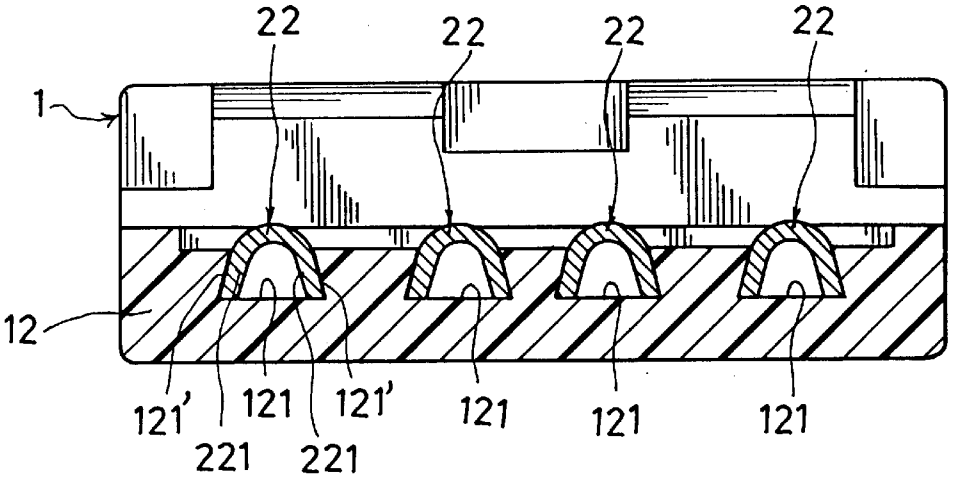
FIG. 6 is a sectional view taken along line 6—6 of FIG. 4.
Figure 7:
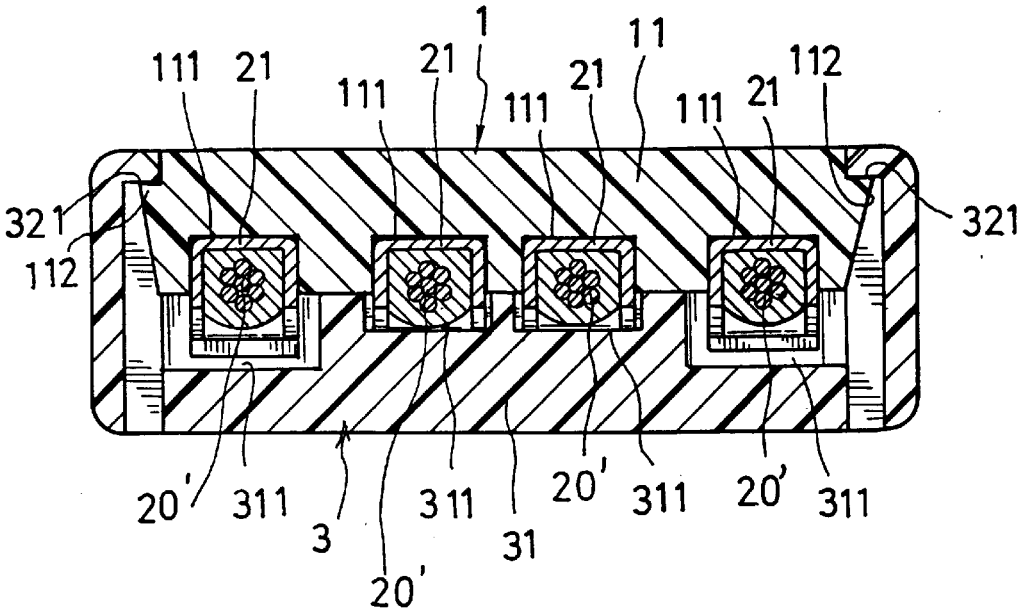
FIG. 7 is a sectional view taken along line 7—7 of FIG. 4.

Referring to FIG. 6, the two lateral walls 121' of the guide cavity 121 of the coupling seat 12 inclinedly oppositely extend toward the opening of the guide cavity, defining a tapered chamber for snugly clamping the cross-sectionally V-shaped lateral slope walls 221 of the conductive coupling section 22 of the contact 2. Therefore, the conductive coupling section 22 of the contact 2 can be securely received in the guide cavity 121 in a bridge pattern. However, the shape of the cross-section of the guide cavity 121 and the conductive coupling section 22 of the contact 2 of the present invention are not limited.

Referring to FIGS. 2, 3, 5 and 7, the cover member 3 includes a cover board section 31 formed with multiple channels 311 on inner side respectively corresponding to the guide channels 111 of the retaining seat 11 of the main body 1 for cooperatively enclosing the cable connecting section 21 of the contact 2 and the cable 20. Two latch boards 32 respectively project from two sides of the cover board section 31. Each latch board 32 is formed with at least one second latch section 321 for engaging with the first latch section 112 of the retaining seat 11, whereby the cover member 3 can be securely detachably assembled with the retaining seat 11 of the main body 1.

The second latch section 321 of the latch board 32 can be a mortise, while the first latch section 112 of the retaining seat 11 can be a reverse hook-like tenon for snugly engaging with the mortise. However, reversely, the second latch section 321 can be a tenon, while the first latch section 112 can be a mortise.

Figure 9:
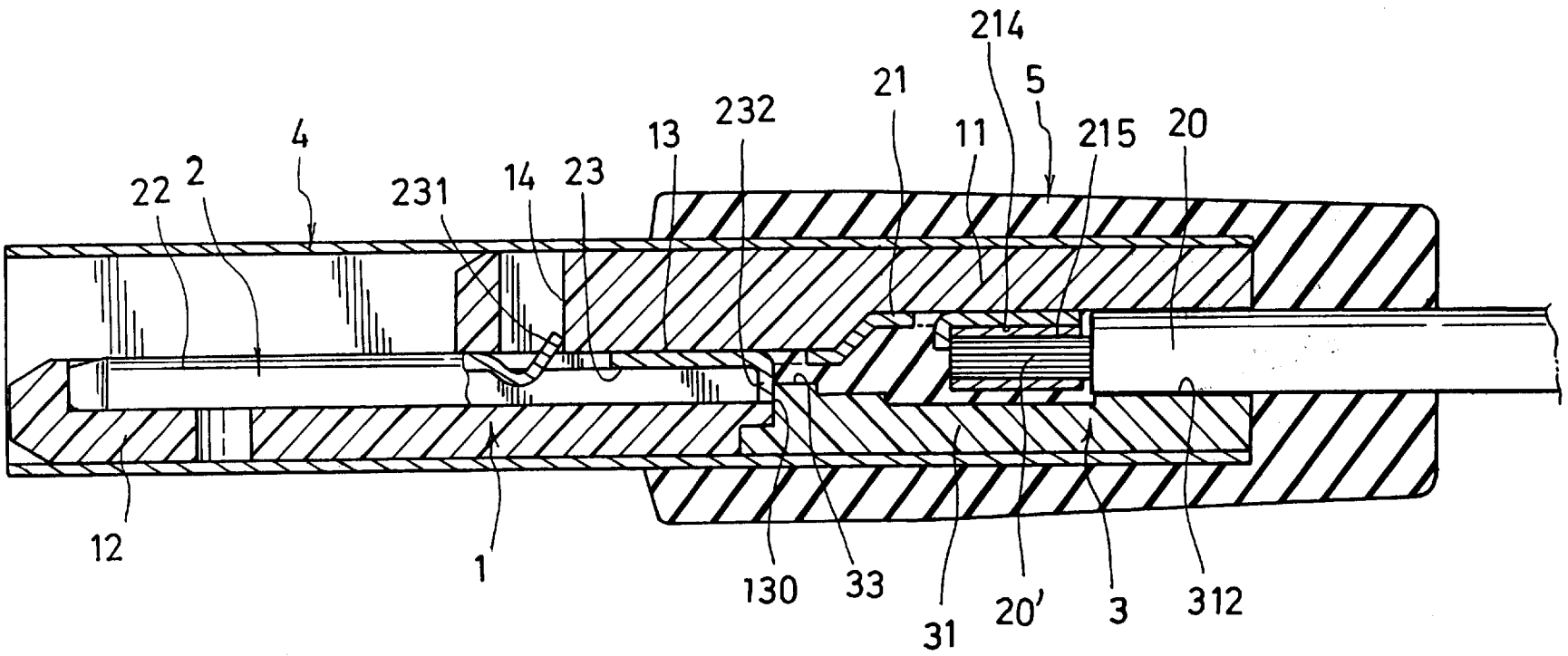
FIG. 9 is a sectional view taken along line 9—9 of FIG. 8.

Referring to FIGS. 2, 5 and 9, a plastic stopper section 33 projects from the front end of the channel 311 of the cover board section 31, whereby when the cover member 3 is assembled with the retaining section 11 of the main body 1, the plastic stopper section 33 seals the rear inlet 130 of the through hole 13 of the main body 1. Therefore, the plastic stopper section 33 and the plastic stopper board 212 of the contact 2 together form double plastic stopper structures to prevent the plastic material of the insulative layer 5 from flowing to the conductive coupling section 22 of the contact 2 in the successive manufacturing procedure. Therefore, the quality of electrical conduction can be ensured.

Figure 8:
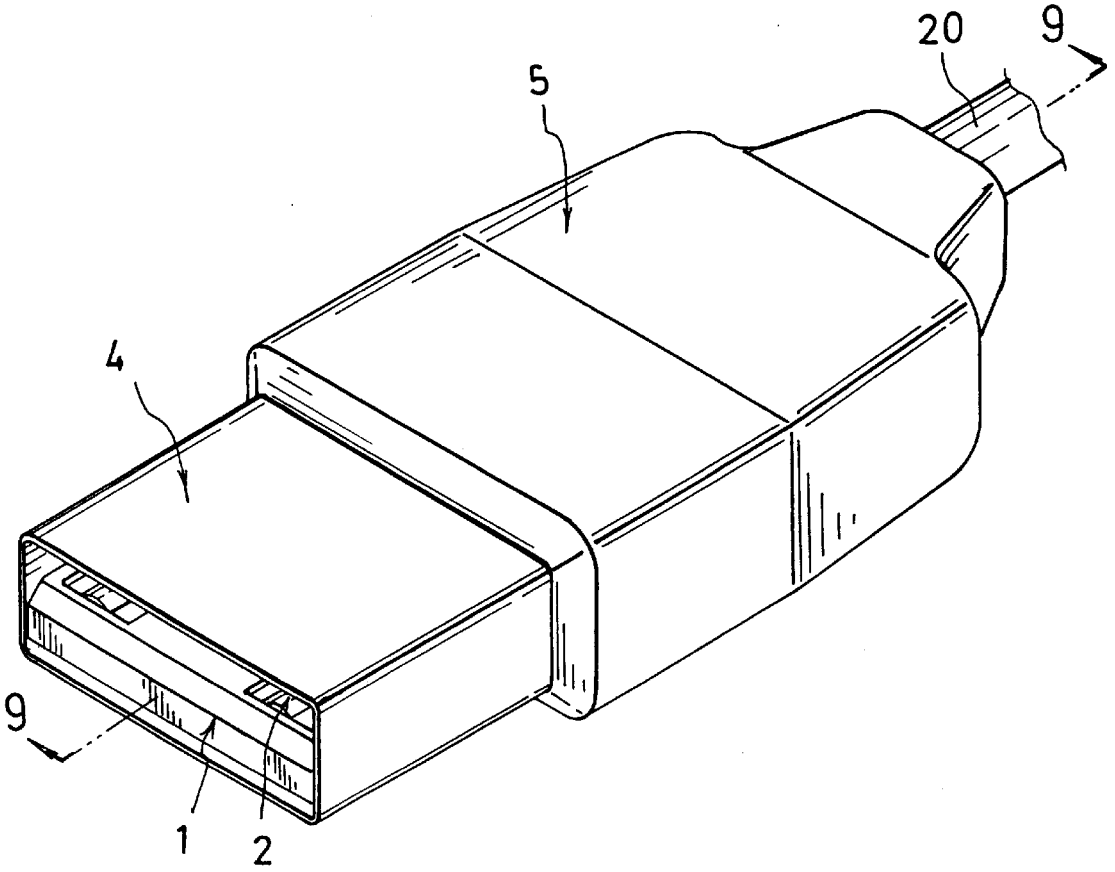
FIG. 8 is a perspective view showing that a metal frame body is fitted around the main body and the metal frame body is coated with an insulative layer.

Referring to FIGS. 4, 8 and 9, after the assembly of the main body 1, contacts 2 and the cover member 3 is completed, a metal frame body 4 is fitted around the main body 1 and the metal frame body 4 is coated with an insulative layer 5 to form the serial bus connector. In the injection operation of the insulative layer 5, the plastic material thereof can flow through the channels 311 of the cover member 3 and the guide channels 111 of the retaining seat 11 of the main body 1. However, the plastic material will be double stopped by the plastic stopper section 33 of the cover board section 31 and the plastic stopper board 232 of the contact 2 and prevented from further going into the through hole 13 of the main body 1. Therefore, the electrical conduction efficiency of the conductive coupling section 22 of the contact 2 can be ensured.

As shown in FIGS. 3 and 5, the retaining seat 11 is longer than the cable connecting section 21 of the contact 2, so that the guide channel 111 of the retaining seat 11 can sufficiently retain the cable connecting section 21 and the bare wire portion 20' of the cable 20. Therefore, after the insulative skin of the cable 20 contacts due to heat during soldering procedure, the bare wire portion 20' remains within the enclosed range of the main body 1 and the cover member 3 without exposion. Accordingly, the bare wire portion 20' of the cable 20 is protected from being torn apart or touching the adjacent one to cause short circuit.

In conclusion, according to the above arrangements, the present invention has the following advantages:

1. The contacts and cover member can be assembled with the main body without using any specific tool so that the equipment cost is reduced.
2. The plastic stopper section and the plastic stopper board of the contact together form double plastic stopper structures to seal the rear inlet of the through hole of the main body, whereby in the successive injection operation of the insulative plastic material for coating the metal frame body, the insulative plastic material is double effectively prevented from flowing through the through hole toward the conductive coupling section of the contact. Therefore, a good efficiency of electrical conduction can be ensured.

It is to be understood that the above description and drawings are only used for illustrating one embodiment of the present invention, not intended to limit the scope thereof. Any variation and derivation from the above description and drawings should be included in the scope of the present invention.

What is claimed is:

1. A cable connecting structure of a serial bus connector, comprising:

a longitudinally extended main body having first and second sides, said main body including (a) a rear retaining seat open to said first side of said main body and having a plurality of guide channels formed longitudinally therein, said rear retaining seat including at least a pair of latch members projecting from opposing sides thereof, and (b) a front coupling seat open to said second side of said main body and having a plurality of guide cavities formed longitudinally therein, each of said plurality of guide cavities having a pair of opposing inwardly inclined side walls, said main body having a plurality of holes formed longitudinally therein in respective open communication with said plurality of guide channels on one end thereof and respective open communication with said plurality of guide cavities on an opposing end, said main body having a plurality of dents formed therein in respective open communication with said holes;

a plurality of contacts respectively inserted into said plurality of holes, each of said plurality of contacts including (a) rear cable connecting section disposed in a respective one of said plurality of guide channels and coupled to a respective cable conductor, (b) a front conductive coupling section disposed in a respective one of said plurality of guide cavities, said front conductive coupling section having sides inclined in a direction to cooperate with said inclined side walls of said respective one of said plurality of guide cavities to secure said front conductive coupling section therein, and (c) a locating section extending between said rear cable connecting section and said front conductive coupling section, said locating section being disposed in a respective one of said holes of said main body and having a stopper board formed in a rear end portion thereof for sealing one end of said hole, said locating section having a resilient latch plate extending therefrom for coupling with a respective one of said plurality of dents;

a cover member releasably coupled to said main body to form a closure for said rear retaining seat for enclosing said rear cable connecting section of said plurality of contacts and the cable conductors, said cover member having at least a pair of latch sections for respective releasable engagement with said pair of latch members of said rear coupling seat, said cover member having a plurality of channels formed therein in correspondence with said plurality of guide channels and at least one stopper section projecting from an inner surface of said cover member for sealing said one end of said holes in combination with a respective stopper board;

a metal frame body surrounding said main body; and, an insulative layer overlaying at least a portion of said metal frame body, said insulative layer being disposed in said plurality of channels of said cover member and said plurality of guide channels and extending to a respective combined stopper board and stopper section.

* * * * *